United States Patent [19]

Kraft

[11] Patent Number: 4,999,868

[45] Date of Patent: Mar. 19, 1991

[54] VARYING FIRMNESS MATTRESS

[76] Inventor: Eugene Kraft, 2760 W. Warren Ave., Detroit, Mich. 48208

[21] Appl. No.: 522,541

[22] Filed: May 11, 1990

[51] Int. Cl.[5] ..... A47C 27/14; A47C 27/20

[52] U.S. Cl. ..... 5/464; 5/481; 5/475

[58] Field of Search ..... 5/464, 481, 462, 448, 5/475

[56] References Cited

U.S. PATENT DOCUMENTS

| | | | |
|---|---|---|---|
| 4,620,337 | 11/1986 | Williams et al. | 5/464 |
| 4,673,452 | 6/1987 | Awdhan | 5/481 |
| 4,679,266 | 7/1987 | Kraft | 5/464 |
| 4,768,251 | 9/1988 | Baskent | 5/481 |
| 4,862,538 | 9/1989 | Spann et al. | 5/464 |
| 4,879,776 | 11/1989 | Farley | 5/464 |
| 4,901,387 | 2/1990 | Luke | 5/464 |

*Primary Examiner*—Alexander Grosz

[57] ABSTRACT

A mattress is formed with an upper variable firmness section covering a lower section of generally uniform firmness. The upper section is divided along its length into four transversely extending regions, namely, a head, an upper torso, a lower torso and a leg support region. The lengths of the regions approximate the average lengths of a preselected range of corresponding human body parts. Thus, the head support region approximates the length of a head and neck; the upper torso region approximates the length of the torso from the neck to the waist; the lower torso region approximates the length from the waist to the crotch; and the leg support region approximates the length of the legs from the crotch to the feet bottoms. Each region is of a substantially uniform firmness, but the firmness is varied from one region to another. Thus, the upper torso region is the firmest region; the head and lower torso regions are about of the same firmnesses and the leg support region is the least firm. The upper section is formed of a resilient, foam rubber-like material which is indented in patterns to provide numerous closely spaced apart hills surrounded by indented valleys, with the firmnesses of the regions being varied by varying the heights of the hills.

7 Claims, 1 Drawing Sheet

VARYING FIRMNESS MATTRESS

BACKGROUND OF THE INVENTION

Conventional mattresses provide a uniform firmness along their lengths and widths. Thus, a conventional mattress, such as those of a conventional coil spring construction or foam rubber-like construction, is relatively soft so that the upper torso of a person supported upon the mattress tends to sag downwardly relative to the legs. In addition, excessively high pressure points are created at the shoulder and hip areas. Typically, since the legs are elevated slightly relative to the lower part of the torso, the individual is not properly supported for maximum comfort. For proper support, the body should be substantially level and the upward support pressure applied along the entire length of the body should be as equal as possible.

In order to provide better support for a person lying upon a mattress, attempts have been made to vary the firmness of the mattress at various locations thereof so as to support the individual more comfortably. One varying firmness mattress, which is disclosed in my prior Pat. No. 4,679,266 issued July 14, 1987, is provided with four zones or regions which are of different firmnesses. In that construction, the mattress is divided longitudinally into a head region, upper torso region, lower torso region, and leg region. These regions are varied in firmness relative to each other. That is, the upper torso region is most firm, the lower torso and head regions are less firm and are generally of about the same firmness, and the leg region is least firm. With that construction, the user's body is held substantially level whether the user is lying upon his back or side and pressure points are relatively equalized.

Other mattresses have been made and are commercially available in which the mattresses have been divided into thirds along their lengths or into other regions that have varying firmnesses. But these have generally not given an adequate or desirable back support or level, comfortable body support as the mattress disclosed in the above patent.

The present invention relates to improving the construction of the mattress disclosed in my prior patent and particularly making it easier and less expensive to provide that type of mattress in different size ranges for different size people. Since the heights and weights of people vary so much, it is not possible to provide a single mattress whose size and varying firmness will provide a comfortable support for all people. Thus, this present invention is concerned with making it feasible to inexpensively provide a number of different size and firmness mattresses, each of which is constructed to be more comfortable to a preselected range of size and weight people.

SUMMARY OF INVENTION

The invention herein contemplates forming a mattress with an upper, pad-like section of varying firmness mounted upon a lower mattress section which may be of generally uniform firmness. The upper section may be formed of a resilient rubber-like material, such as foam plastic or foam rubber or the like, generally characterized as foam rubber-like material. The material is preferably formed with patterns of surface depressions to provide hills and valleys in a roughly egg-crate like configuration or in a channel configuration. By appropriately adjusting the heights and widths and shapes of the depressions, that is, the configurations of hills and valleys or convolutions or channels, the firmnesses of the upper section may be varied in different regions even if the upper section is formed of a uniform density material.

The invention contemplates forming the pad in four regions, namely, a head, upper torso, lower torso and leg region with the regions varying in firmness to approach equalized upward pressure along the body length. Thus, the upper section of the mattress when mounted upon a generally uniform firmness mattress construction, such as a conventional coil spring construction or foam construction, provides four body part support regions. By appropriately selecting the firmnesses and the lengths of the regions, the mattress can accommodate a preselected range of size and weight people. Thus, by combining different, inexpensive, upper sections, with common, more expensive, inner or lower sections, relatively inexpensive mattresses may be produced to accommodate a number of ranges of different size people.

Moreover, the invention contemplates forming an overall mattress construction with a duplicate padlike upper section and a similar bottom section between which a conventional construction middle section is located. Thus, the mattress may be turned over and either surface may be used.

One object of the invention is to provide a relatively inexpensive mattress construction where pad-like upper sections can be applied upon more expensive, larger support sections and the pad sections can be preselected for a particular range of sizes of people.

Another object of this invention is to provide a relatively inexpensive, four region pad which can be applied upon a conventional mattress-like construction, to provide varying firmnesses to accommodate different size human bodies and to support these comfortably in a level position.

Still another object of this invention is to provide a relatively inexpensive structure having varying firmness support regions of predetermined length for accommodating preselected ranges of sizes of people.

Still a further object of this invention is to provide an inexpensive mattress pad which is constructed with four separate, varying firmness regions, which pad can be positioned upon a conventional mattress to more comfortably support the user thereof.

These and other objects and advantages of this invention will become apparent upon reading the following disclosure of which the attached drawings form a part.

DETAILED DESCRIPTION

Figure 1:
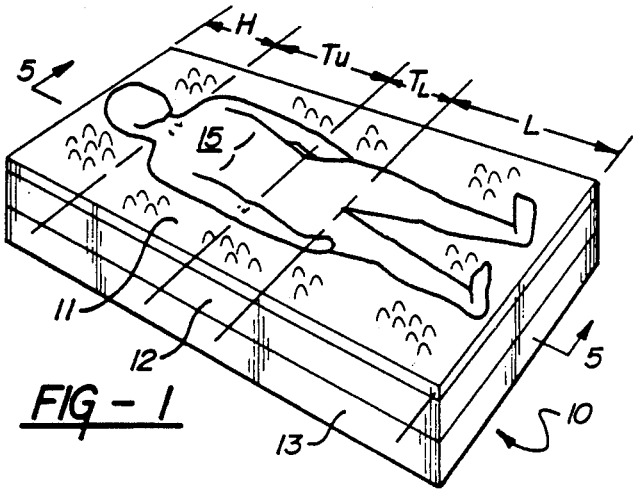
FIG. 1 is a schematic, perspective view of the improved mattress with a schematic illustration of a person resting thereon.
Figure 3:
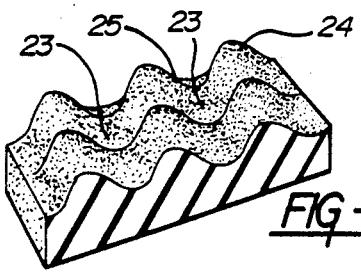
FIG. 3 is a fragmentary, perspective view of a convoluted or depressed upper section.
Figure 4:
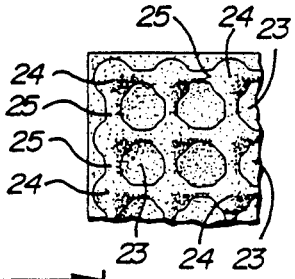
FIG. 4 is a plan view of a fragment of the upper section, showing the convolutions and hills formed thereon.
Figure 2:
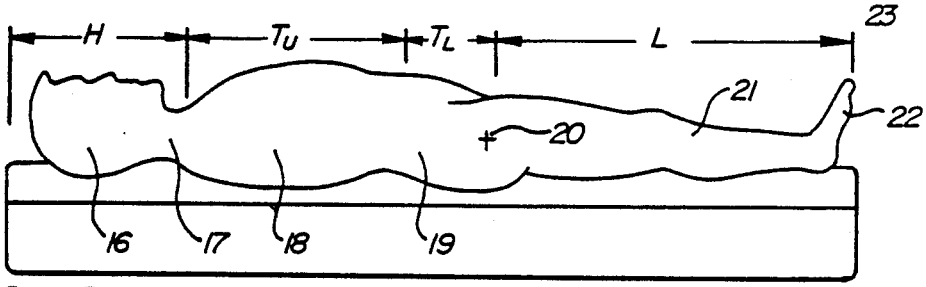
FIG. 2 is a schematic, side elevational view of a person resting upon the mattress.

FIG. 1 illustrates a bed 10 with a mattress formed with an upper, pad-like section 11 supported upon a lower section 12. The lower section is formed of a conventional spring or foam or the like mattress construction. The mattress is supported upon a conventional foundation 13, such as a box-spring or the like.

The drawings illustrate, schematically, a person 15 lying upon the mattress. Schematically shown are the person's head 16, neck 17, upper torso 18, lower torso 19, leg joint 20, which is generally aligned with the crotch, and legs 21 with feet 22.

In order to comfortably support the person, the mattress upper section 11 is divided into four major regions. The regions extend from side to side of the mattress and extend in the longitudinal direction distances which roughly are equal to four corresponding body portions. That is, the first region H is roughly equal to the average height of a preselected range of body heights of a head and neck. The next region $T_u$ is roughly of the length of the average upper torso of a preselected range of body sizes. Similarly, the next region $T_L$ is roughly equivalent to the length of the average lower torso of the body, and the lowermost region L is equivalent to the length of the legs, from the crotch or leg joint 20 to the bottoms of the feet 22. The length of the lower torso region is roughly about one-half of the length of the upper torso region.

Most adult humans have head and neck heights that are relatively close, that is, generally about the same length, with only small variations. However, the upper and lower torso regions and the leg regions may vary considerably for different size people. Thus, it is contemplated that a preselected average size will be utilized for a particular mattress construction. Thus, a series of mattresses can be made with regions of different sizes, with each of the series designed to more closely accommodate the average size of a particular preselected size range.

By way of example, the mattress upper section, for a standard nominal length 75-inch long mattress, may have a head region which is about 18.7 percent of the length, or about 14 inches, and a torso region which is roughly 37.3 percent of the overall length, or about 28 inches, and a leg region which is about 44 percent of the mattress length, or about 33 inches. The torso region may be divided into the upper torso region having about 24 percent of the length of the mattress, or about two-thirds of the overall torso region, such as in the range of about 18 inches. The lower torso region may be approximately 12.5 percent of the length of the mattress, or about 9 inches in length, representing about one-third of the overall torso region.

For a standard 80-inch long mattress, the head region may be about 14 inches in length, the upper torso region may be about 18 inches in length, the lower torso region may be about 12 inches in length, and the leg region may be about 36 inches in length. This will accommodate a range of people who are relatively tall with much of their added height in their legs.

As can be seen from the foregoing examples, the different regions can be of different lengths so as to approximate average lengths of preselected sizes which will make the bed more comfortable.

In order to vary the firmness of the upper section or pad portion 11, four different rubber-like foam densities and firmnesses may be selected and joined together edge to edge with a suitable adhesive. This can be accomplished by using slabs of resilient, foam-like rubber of preselected density, but with different firmnesses. Preferably, the regions utilize a single density foam rubber-like material which may be made of natural latex or natural rubber or, alternatively, suitable foam plastic material. The pad is provided with numerous depressions or indentations which form valleys 23 and upwardly extending hills 24 which are joined together by narrow joint strips 25. This structure, sometimes referred to as a convoluted configuration or an egg-crate configuration, depending upon the pattern, is formed by either a press or roller provided with suitable indentation-forming bosses applied against a slab of foam material. The application usually includes sufficient heat to permanently form the required indentations. Alternatively, some or all of the indentations may be cut out.

Figure 6:
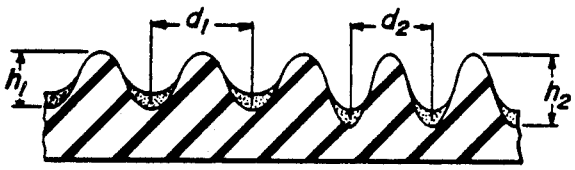
FIG. 6 is an enlarged, cross-sectional, fragmentary view of a portion of the upper section showing the varying height and width hills formed therein.

Varying the depths and widths and shapes of the indentations, which varies the heights of the hills and joint strips, produces variations in the firmness of the upper section. Thus, by utilizing a lower hill $h_1$, as schematically illustrated in FIG. 6, a more firm section is provided as compared with a taller hill $h_2$. The taller the hill, the more it yields under weight. This provides a softer or less firm support while simultaneously providing a more plush or comfortable feeling. In addition, the widths or diameters of the hills near their bottoms affect the firmness provided by each specific hill. Thus, the width $d_1$ of the shorter hills provides greater firmness than the narrower widths $d_2$ of the taller hills, as illustrated in FIG. 6.

By varying the heights and frequencies of the hills, which are obtained by the varying the depths of the depressions or indentations, each region of the upper section can be of a uniform firmness, but with the firmness of one section being different than the firmness of the next section.

The upper torso region $T_u$ is the most firm of the regions. The head support region H is of lesser firmness than the upper torso region. The leg support region L is of lesser firmness than the head support region. The lower support region $T_L$ is roughly similar to the firmness of the head support region, that is, it can be the same or, with small variation, slightly more or less firm than the head support region. With this varying firmness, the typical user of the mattress will be supported comfortably and levelly in both back and side support positions.

Figure 5:
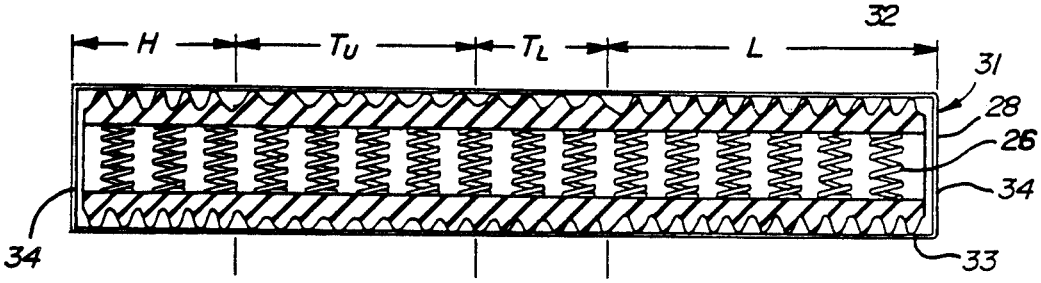
FIG. 5 is a schematic, cross-sectional view of the mattress with an upper and a bottom section sandwiching a spring mattress construction between them to form the overall mattress.

The mattress lower section 12, which is schematically illustrated in FIG. 5, may be made of a conventional coil spring construction utilizing conventional coil springs 25. Coil springs used in mattresses may vary in diameter, height or configuration. That is, they may be cylindrically shaped, barrel shaped, hour-glass shaped or the like.

Figure 7:
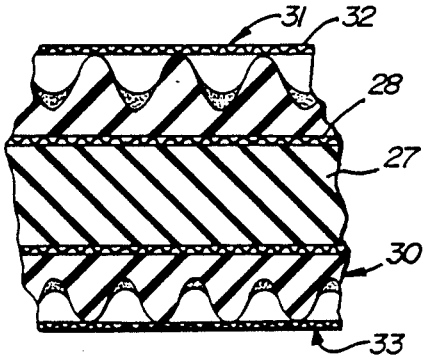
FIG. 7 is an enlarged, cross-sectional view showing a fragmentary portion of the mattress in cross section, with a foam rubber-like core or lower section.

Alternatively, the mattress lower section may be of a foam mattress type 27, as illustrated in FIG. 7. The mattress lower section could even be an air inflated mattress or water bed construction, that is, with a water filling, although preferably it is either of a spring construction or a foam construction, as illustrated.

The mattress lower section may be covered with a cloth-like cover 28. The upper section may be sewn to or adhered to the lower section using a suitable adhesive. Alternatively, the upper section may be formed as a separate, loose pad that may be positioned upon a pre-existing bed.

Preferably, the upper section 11 is duplicated by a lower section 30 constructed in the same manner with the same body support regions. The lowermost or bottom section 30 is inverted, however, as compared to the upper section. Then, the entire mattress is enclosed within a cloth-like envelope or cover 31 formed of a woven fabric or sheet plastic. The envelope has an upper cover portion 32, a lower cover portion 33 and a side 34 encircling the periphery of the mattress. With this construction, the mattress may be turned upside down when desired to reverse the support surfaces. In turning the mattress upside down, the mattress should be turned sideways or transversely, but not end to end or longitudinally, in order to preserve the four support sections in proper position.

The foundation 13 may be of a conventional box-spring construction with suitable legs or a conventional support frame. However, other conventional bed foundations without springs may be used with the mattress described above.

The particular foam or rubber-like material selected for the upper section, whether convoluted or slab-like, may vary depending upon availability, costs and desired firmness. Thus, the selection of such material may be accomplished by one skilled in the art, by trial and error, to provide the desired firmness for each of the body support regions. The body support regions may each be made of a separate piece of foam rubber-like material with the pieces joined together end to end by a suitable, commercially available adhesive, to produce the entire length required. Alternatively, a single piece may be used by forming the varying indentations and hills at the different regions.

This invention may be further developed within the scope of the following claims. Accordingly, it is desired that the foregoing description be read as being merely illustrative of an operative embodiment of this invention and not in a strictly limiting sense.

Having fully described at least one operative embodiment of this invention, I now claim:

1. A variable firmness mattress for comfortable and substantially level support of a person of a predetermined range of height and weight, comprising:

a lower support section extending the full length and width of a predetermined size mattress, and an upper support section substantially covering and supported upon the lower support section;

the upper support section being of a varying firmness along its length and the lower support section being of generally uniform firmness along its length as compared with the upper support section;

the upper section having an upper, head end and a lower, foot end, and being divided along its length from the upper towards the lower end into four sequential major body support regions, each of which extend transversely of the mattress, namely, a head support region, an upper torso support region, a lower torso support region, and a leg support region;

said upper section being formed of a plurality of hills surrounded by a plurality of valleys, the heights of the hills in each of said regions being substantially uniform, but with the heights varying from one region to another, with the hills in less firm regions being of greater height than the hills of the more firm regions, that is, with the valleys of the less firm regions being of greater depth, than the depths of the valleys of the more firm regions, whereby the varying firmnesses of the regions are obtained by varying the heights of the hills, with the sides of hills being generally shaped so that the crosssectional widths of the hills increase from top to bottom and are substantially uniform for the hills in each region, but said widths vary from region to region to provide, at least in part, the varying firmness of the regions;

said regions each being of a length to approximate a corresponding length of a part of an average human body of a preselected average height;

with the head support region extending from the section upper end a distance roughly equal to the height of an average head and neck;

with the upper torso support region extending from the head support region towards the section lower end a distance roughly equal to the average distance between the juncture of the neck and shoulders to the waist;

with the lower torso support region extending from the upper support region towards the section lower end a distance roughly equal to the average distance between the waist and crotch, and with the upper torso support region being roughly two-thirds of, and the lower support region being roughly one-third of, the total length of the average preselected size range torso;

and the leg support region extending from the lower torso support region to the lower end of the section, and extending a distance roughly equal to the length of the legs of the average person from the crotch to the bottoms of the feet;

and each of the regions being of a substantially uniform resilient firmness, but with the upper torso region being the most firm of the regions, the head support region being of a lesser firmness than the upper torso region and the leg support region being of a lesser firmness than the head support region, and the lower torso support region being of roughly about the same firmness as the head support region;

and with the firmness of each region being preselected so that when the respective regions are depressed by a person resting upon the mattress, the regions together provide a substantially level body support, with substantially equal support pressure upon the body along the length of the mattress and said mattress including a bottom section which is a substantial duplicate of the upper section and is applied against the lower surface of the lower section with its hills extending downwardly, wherein the mattress may be turned upside down for use of either of its uppermost or lowermost sections as the body support surface.

2. A mattress as defined in claim 1, and said upper section being formed of a resilient, relatively thin pad which is formed with said four firmness regions along its length.

3. A mattress as defined in claim 1, and said upper section being formed of a pad made of a resilient material, such as foam plastic or rubber-like material, and the entire upper surface of the pad being formed with closely adjacent, but separated hills, with each hill being substantially surrounded by a depressed valley-like formation, and the crests of all the hills being in the same horizontal plane to form a planar body support surface.

4. A mattress as defined in claim 3, and said mattress lower section being formed of a conventional mattress construction, such as a conventional coil spring or foam type construction, with the upper section resting upon the upper surface of said construction.

5. A mattress as defined in claim 1, and including the mattress being enclosed within a cloth-like envelope so that said hills are covered and not visible.

6. A mattress as defined in claim 1, and with the hills being generally truncated, conical in shape.

7. A variable firmness mattress for comfortable and substantially level support of a person of a predetermined range of height and weight, comprising:

a lower support section extending the full length and width of a predetermined size mattress, and an upper support section substantially covering and supported upon the lower support section;

the upper support section being of a varying firmness along its length and the lower support section being of generally uniform firmness along its length as compared with the upper support section;

the upper section having an upper, head end and a lower, foot end, and being divided along its length from the upper towards the lower end into four sequential major body support regions, each of which extend transversely of the mattress, namely, a head support region, an upper torso support region, a lower torso support region, and a leg support region;

said upper section being formed of a plurality of hills surrounded by a plurality of valleys, with the valleys of the less firm regions being of greater depth, than the depths of the valleys of the more firm regions, whereby the varying firmnesses of the regions are obtained by varying the heights of the hills, with the sides of hills being generally shaped so that the cross-sectional widths of the hills increase from top to bottom;

said regions each being of a length to approximate a corresponding length of a part of an average human body of a preselected average height;

with the head support region extending from the section upper end a distance roughly equal to the height of an average head and neck;

with the upper torso support region extending from the head support region towards the section lower end a distance roughly equal to the average distance between the juncture of the neck and shoulders to the waist;

with the lower torso support region extending from the upper support region towards the section lower end a distance roughly equal to the average distance between the waist and crotch, and with the upper torso support region being roughly two-thirds of, and the lower support region being roughly one-third of, the total length of the average preselected size range torso;

and the leg support region extending from the lower torso support region to the lower end of the section, and extending a distance roughly equal to the length of the legs of the average person from the crotch to the bottoms of the feet;

and each of the regions being of a substantially uniform resilient firmness, but with the upper torso region being the most firm of the regions, the head support region being of a lesser firmness than the upper torso region and the leg support region being of a lesser firmness than the head support region, and the lower torso support region being of roughly about the same firmness as the head support region;

and with the firmness of each region being preselected so that when the respective regions are depressed by a person resting upon the mattress, the regions together provide a substantially level body support, with substantially equal support pressure upon the body along the length of the mattress and said mattress including a bottom section which is a substantial duplicate of the upper section, wherein the mattress may be turned upside down for use of either of its sections as the body support surface.

* * * * *